US010156090B2

(12) United States Patent
Goppion

(10) Patent No.: US 10,156,090 B2
(45) Date of Patent: Dec. 18, 2018

(54) MUSEUM SHOWCASE WITH AN INVISIBLE GASKET

(71) Applicant: GOPPION S.P.A., Trezzano Sul Naviglio (MI) (IT)

(72) Inventor: Alessandro Goppion, Milan (IT)

(73) Assignee: GOPPION S.P.A., Trezzano sul Naviglio (IT)

( * ) Notice: Subject to any disclaimer, the term of this patent is extended or adjusted under 35 U.S.C. 154(b) by 0 days.

(21) Appl. No.: 15/228,623

(22) Filed: Aug. 4, 2016

(65) Prior Publication Data

US 2018/0010382 A1 Jan. 11, 2018

(30) Foreign Application Priority Data

Jul. 11, 2016 (IT) ..... UA2016A005086

(51) Int. Cl.
*A47F 3/00* (2006.01)
*E06B 5/00* (2006.01)

(52) U.S. Cl.
CPC ..... *E06B 5/006* (2013.01); *A47F 3/005* (2013.01)

(58) Field of Classification Search
CPC ..... E06B 7/16; E06B 7/22; E06B 7/23; E06B 7/2303; E06B 5/006; A47F 3/005; A47F 3/007; A47F 2003/008
See application file for complete search history.

(56) References Cited

U.S. PATENT DOCUMENTS 3,633,790 A * 1/1972 Voss ..... A01K 63/003 119/269
4,660,903 A * 4/1987 Shinagawa ..... A47F 3/0434 312/116
4,891,912 A 1/1990 Bockwinkel
5,524,977 A * 6/1996 Orawski ..... A47F 3/005 312/114
6,042,202 A * 3/2000 Goppion ..... A47F 3/005 292/302
6,375,284 B1 * 4/2002 Frank ..... A47B 47/00 312/140
6,398,322 B1 * 6/2002 Chaplin ..... A47F 3/005 312/114
6,406,108 B1 * 6/2002 Upton ..... A47F 3/001 312/116
2005/0223646 A1 * 10/2005 Kim ..... E06B 7/16 49/478.1

FOREIGN PATENT DOCUMENTS

DE 202008012162 U1 11/2008
GB 2529376 A 2/2016

OTHER PUBLICATIONS

Italian Search Report and Written Opinion for Italian application UA2016A005086 filed Jul. 11, 2016 on behalf of GOPPION S.P.A. (English translation of Re item V of the Written Opinion) dated Mar. 15, 2017. 6 pages.

* cited by examiner

*Primary Examiner* — Daniel J Rohrhoff
(74) *Attorney, Agent, or Firm* — Steinfl + Bruno, LLP

(57) ABSTRACT

This showcase for conserving and displaying objects in a protected environment comprises a case, fixed walls, an openable wall and a gasket housed in a seat formed in part in the fixed walls and in part in the openable wall, open towards the interior of the showcase. The showcase ensures better security, since the gasket cannot be reached from the outside (unless the showcase is open) and therefore any possibility of tampering is avoided.

6 Claims, 2 Drawing Sheets

MUSEUM SHOWCASE WITH AN INVISIBLE GASKET

CROSS-REFERENCE TO RELATED APPLICATIONS

The present application claims priority to Italian Application No. UA2016A005086 filed on Jul. 11, 2016, which is incorporated herein by reference in its entirety.

FIELD

The present invention refers to a museum showcase intended for being arranged in a display room such as a museum, an exhibition or similar and intended for conserving and displaying items of cultural heritage, such as works of art, historical artefacts and similar, in a protected environment. Hereinafter, sometimes for the sake of brevity just the term showcase will be used, by this in any case still meaning a museum showcase.

Here and hereinafter the term protected environment is meant to indicate an environment in which the atmosphere is controlled, by monitoring one or more parameters including temperature, humidity, dust content, pollutant content, in order to maintain the foreseen conservation conditions of the displayed objects, and wherein the possibility of access for unauthorised people is prevented to avoid thefts and damage to the displayed objects.

BACKGROUND

In order to ensure the best seal, the sealing systems between fixed walls and mobile walls, i.e. normally between the fixed abutment frame and the mobile frame respectively provided on the fixed and mobile part of the showcase are extremely important.

For this purpose, more or less compressible gaskets are used together with further closure means to apply a pressure between the fixed walls that form the fixed case of the showcase and the mobile wall of the showcase itself. The closure means that hold the mobile wall against the fixed case are normally located in some points along the abutment frame generally visible to the observer.

Therefore, there is the problem of having gasket means in a position not directly visible to the observer and suitable for ensuring the desired seal.

SUMMARY

Consequently, the present invention concerns a museum showcase according to claim 1; preferred characteristics are given in the dependent claims.

More specifically, the showcase comprises fixed walls, at least one openable wall, a sealing gasket between the openable wall and the fixed walls, characterised in that the gasket is housed in a seat formed in part in the fixed walls and in part in the openable wall, open towards the interior of the showcase.

Thanks to this gasket, the showcase ensures greater security, since the gasket cannot be reached from the outside (unless the showcase is open) and therefore any possible tampering is prevented. Moreover, the gasket in that position is practically invisible from the outside, with the showcase closed.

Preferably, the gasket of the showcase is a magnetic gasket.

Thanks to the magnetic gasket the perfect airtight seal of the showcase is ensured, eliminating the need to use separate closure means.

Preferably, the walls have a layered structure and comprise at least two coupled glass sheets.

Thanks to this characteristic, the security of the showcase is further improved since the layered glass does not split into multiple pieces when broken. Indeed, upon breaking, an intermediate layer intervenes, holding together the glass layers that surround it. In this way, even if the glass breaks, it does not leave its seat risking to place nearby objects or people in danger.

Preferably, the magnetic gasket comprises two separate parts that attract one another and in which one of said parts is elastically deformable.

Thanks to this characteristics the gasket has high sealing adaptability since it better compensates for small deformations of the glass due to flexing, which are not negligible particularly in the case of large sized showcases.

Preferably, the elastically deformable part of the magnetic gasket comprises, in a central portion, recesses that ensure the compression deformability thereof.

Thanks to this characteristic, the showcase has high sealing adaptability since it is capable, through the central recesses, of absorbing deformations.

Preferably, the fixed and openable walls of the showcase have an inner face, an outer face and an edge face inclined by 45° with respect to the outer face, in which the housing seat of the gasket comprises two grooves, a first groove formed in the fixed walls between the inner face and the edge face thereof, and a second groove formed in the openable wall between the inner face and the edge face thereof.

BRIEF DESCRIPTION OF DRAWINGS

Further characteristics and advantages of the invention will become clearer from the following description of a preferred embodiment of a showcase according to the invention, made with reference to the attached drawings. In such drawings.

DESCRIPTION

Figure 1:
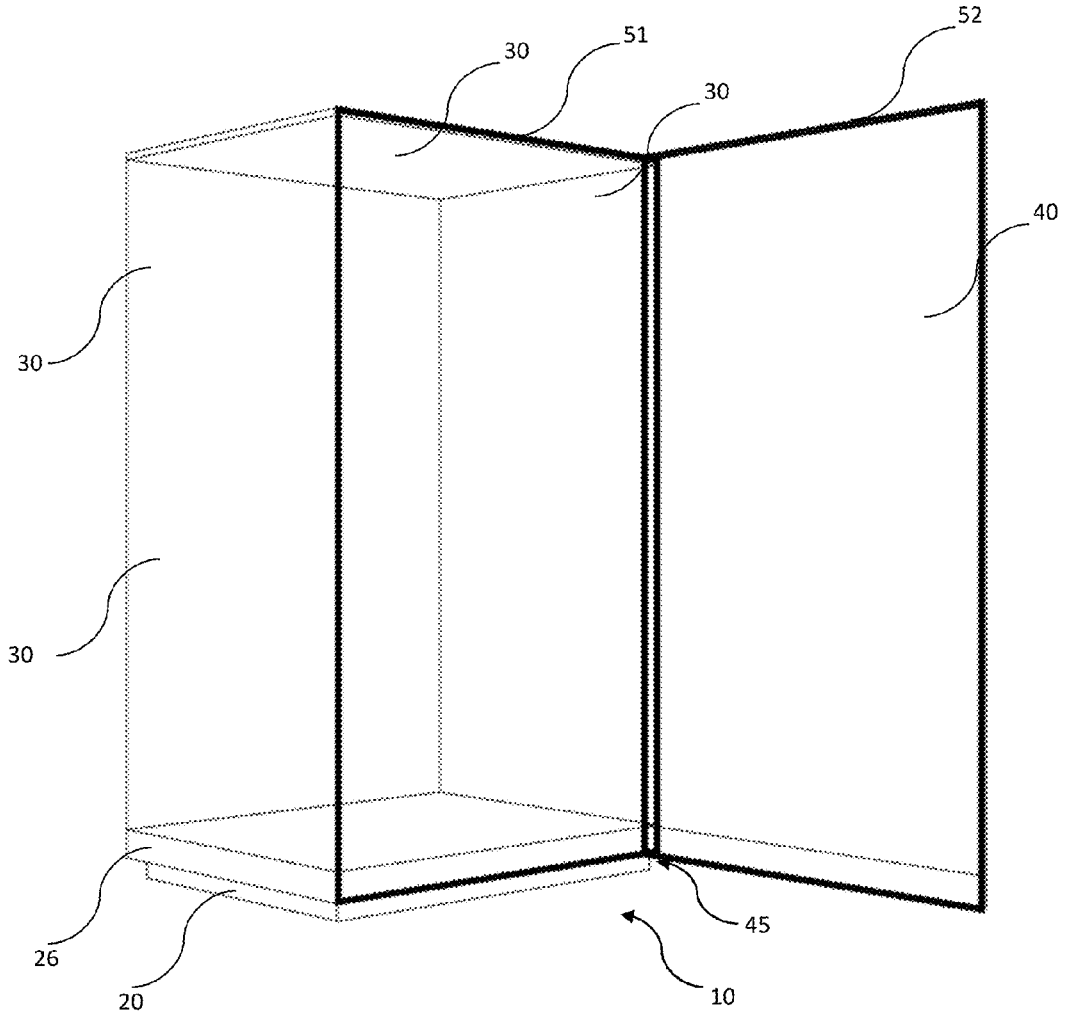
FIG. 1 is a perspective view of a showcase according to the invention.

In the figures, reference numeral 10 wholly indicates a showcase according to the invention. The showcase 10 comprises a base 20, with a case 26 mounted on top formed from fixed walls welded together, all indicated with 30, and an openable wall 40. In the illustrated example, the showcase 10 is substantially parallelepiped shaped and therefore there are four fixed walls 30, three side walls and one upper wall.

The fixed walls 30 and the openable wall 40 have a layered structure and each comprise at least two coupled glass sheets 48, 49.

Between the openable wall 40 and the fixed walls 30 there is a gasket 45 housed in a seat 46 formed in part in the fixed walls 30 and in part in the openable wall 40, open towards the interior of the showcase 10. The grooves 50, 70 are positioned in an inner portion of the walls of the museum showcase 10, and faces towards the interior of the showcase 10.

The gasket 45 of the showcase is a magnetic gasket.

Figure 2:
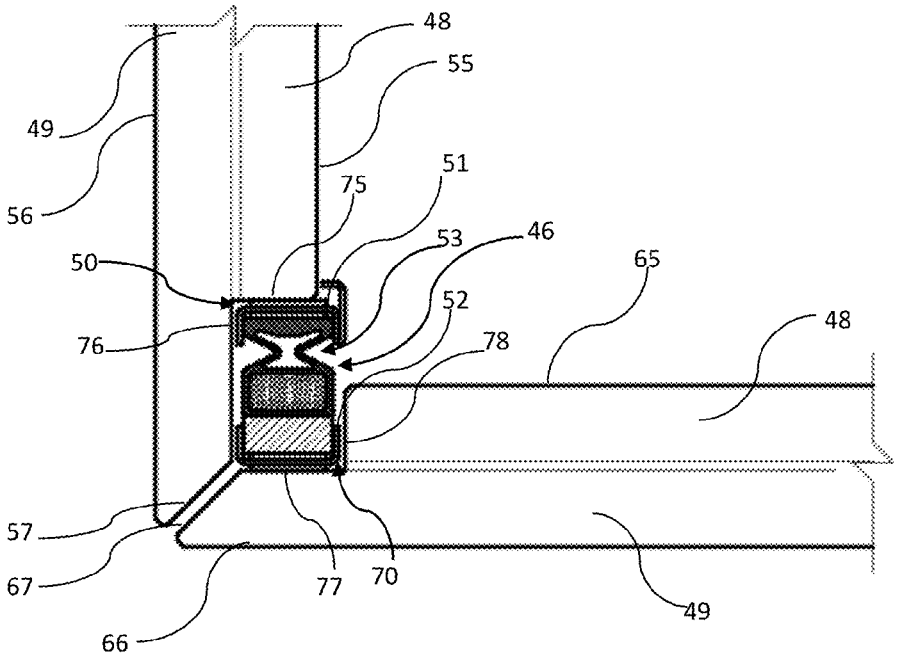
FIG. 2 is a section view of a detail of the showcase of FIG. 1 in closed position.
Figure 3:
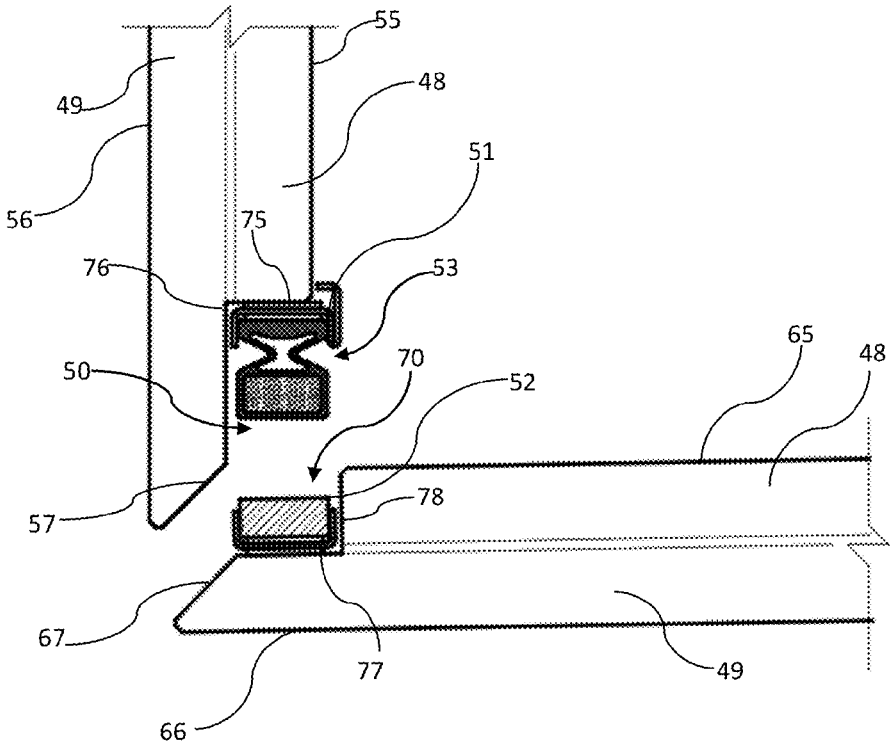
FIG. 3 is a section view of a detail of the showcase of FIG. 1 in open position.

With particular reference to FIGS. 2 and 3, the magnetic gasket 45 comprises two parts that attract one another:

a part 51 of magnetic material, coated in rubber;

a part 52 of ferrous material, also coated in rubber.

In particular, the part 51 is elastically deformable and comprises, in a central portion, recesses 53 that ensure the compression deformability of the magnetic gasket 45.

The fixed walls 30 of the showcase 10 each have an inner face 55, an outer face 56 and an edge face 57 inclined by 45° with respect to the outer face 56. The groove 50 is formed in depth in the inner sheet 48 of the fixed walls 30 by a middle area of the edge face 57 and along the inner face 55 of the walls 30.

The openable wall 40 of the showcase 10 has an inner face 65, an outer face 66 and an edge face 67 inclined by 45° with respect to the outer face 66. The housing seat 46 of the gasket 45 is formed from two grooves, a first groove 50 formed in the fixed walls 30 between the inner face 55 and the edge face 57 thereof, and a second groove 70 formed in the openable wall 40 between the inner face 65 and the edge face 67 thereof.

The groove 50 has a bottom 75 to which the part 51 of the gasket 45 is connected and a flank 76, perpendicular to the bottom 75.

The groove 70 has a bottom 77 to which the part 52 of the gasket 45 is connected and a flank 78 perpendicular to the bottom 77; the bottom 77 of the groove 70 faces towards the bottom 75 of the groove 50, when the showcase 10 is closed.

The flank 76 of the groove 50 has a greater length than the flank 78 of the groove 70.

The bottoms 75 and 77, as well as the part 52 of the gasket 45, have a width corresponding to about half of the thickness of the openable wall 40 and of the fixed walls 30 of the showcase 10.

The presence of the magnetic gasket 45, thanks to the attraction between the part 51 and the part 52, ensures the correct sealed closure of the showcase, even in the presence of possible small shape or position errors, also eliminating the need to use separate closure means.

When the showcase 10 is closed, the gasket 45 is also actually invisible from the outside, since it faces towards the interior of the showcase, inserted in the seat 46.

Those skilled in the art could also, without difficulty, make modifications to the showcase 10 described, without however departing from the scope of protection defined by the following claims. For example, it is possible to use a non-magnetic gasket 45, exploiting the housing seat 46 of the gasket, while at the same time needing separate closure means.

The invention claimed is:

1. A museum showcase, comprising fixed walls, at least one openable wall, a sealing gasket between the openable wall and the fixed walls, wherein the sealing gasket is housed in a seat formed in part in the fixed walls and in part in the openable wall by a first groove formed in the fixed walls and a second groove formed in the openable wall, open towards the interior of the museum showcase, and wherein:

the sealing gasket is a magnetic gasket, the magnetic gasket comprises two separate parts that attract each other, including an elastically deformable part connected to a bottom of the first groove and a part connected to a bottom of the second groove, the first groove having a depth extending parallel to the fixed walls, and the second groove having a depth extending in a direction perpendicular to the openable wall, the elastically deformable part of the magnetic gasket comprises, in a central portion, recesses to ensure compression deformability of the magnetic gasket, the first groove houses the magnetic elastically deformable part of the gasket and is deeper than the second groove, the fixed walls have a layered structure and comprise at least two coupled glass sheets, the openable wall has a layered structure and comprises at least two coupled glass sheets, the at least two coupled glass sheets of the fixed walls and of the openable wall include at least an inner glass sheet, the first groove is formed in the inner glass sheet of the fixed walls, the second groove is formed in the inner glass sheet of the openable wall, and the at least two coupled glass sheets of the fixed walls are coupled directly to each other.

2. The museum showcase according to claim 1, wherein the fixed walls and the openable wall of the showcase have an inner face, an outer face and an edge face inclined at 45° with respect to the outer face.

3. The museum showcase according to claim 1, wherein the first groove has a depth extending parallel to the fixed walls, and the second groove has a depth extending in a direction perpendicular to the openable wall.

4. A museum showcase, comprising fixed walls, at least one openable wall, a sealing gasket between the openable wall and the fixed walls, wherein the sealing gasket is housed in a seat formed in part in the fixed walls and in part in the openable wall by a first groove formed in the fixed walls and a second groove formed in the openable wall, open towards the interior of the museum showcase, and wherein:

the sealing gasket is a magnetic gasket, the magnetic gasket comprises two separate parts that attract each other, including an elastically deformable part connected to a bottom of the first groove and a part connected to a bottom of the second groove, the first groove having a depth extending parallel to the fixed walls, and the second groove having a depth extending in a direction perpendicular to the openable wall, the elastically deformable part of the magnetic gasket comprises, in a central portion, recesses to ensure compression deformability of the magnetic gasket, the first groove houses the magnetic elastically deformable part of the gasket and is deeper than the second groove, and compression deformability of the elastically deformable part and a magnetic attraction force between the two separate parts of the magnetic gasket both act in a direction parallel to an opening direction of the openable wall.

5. A museum showcase, comprising fixed walls, at least one openable wall, a sealing gasket between the openable wall and the fixed walls, wherein the gasket is housed in a seat formed in part in the fixed walls and in part in the openable wall by a first groove formed in the fixed walls and a second groove formed in the openable wall, open towards the interior of the museum showcase, and wherein:

the sealing gasket is a magnetic gasket, the magnetic gasket comprises two separate parts that attract each other wherein one of said parts is an elastically deformable part, the elastically deformable part of the magnetic gasket comprises, in a central portion, recesses to ensure compression deformability of the magnetic gasket, the first groove houses the magnetic elastically deformable part of the gasket and is deeper than the second groove, and the elastically deformable part of the magnetic gasket remains deformed while the museum showcase is closed.

6. A museum showcase, comprising fixed walls, at least one openable wall, a sealing gasket between the openable wall and the fixed walls, wherein the sealing gasket is housed in a seat formed in part in the fixed walls and in part in the openable wall by a first groove formed in the fixed walls and a second groove formed in the openable wall, open towards the interior of the museum showcase, and wherein:

the sealing gasket is a magnetic gasket, the magnetic gasket comprises two separate parts that attract each other, including an elastically deformable part connected to a bottom of the first groove and a part connected to a bottom of the second groove, the first groove having a depth extending parallel to the fixed walls, and the second groove having a depth extending in a direction perpendicular to the openable wall, the elastically deformable part of the magnetic gasket comprises, in a central portion, recesses to ensure compression deformability of the magnetic gasket, the first groove houses the magnetic elastically deformable part of the gasket and is deeper than the second groove, and compression deformability of the elastically deformable part and a magnetic attraction force between the two separate parts of the magnetic gasket both act in a direction parallel to the fixed walls and perpendicular to the openable wall.

* * * * *